United States Patent [19]

Potter

[11] 4,095,362

[45] Jun. 20, 1978

[54] POST CARD DISPLAYER FASTENING ON BULLETIN BOARD

[76] Inventor: Glenn J. Potter, 1332 S. Hope St., Los Angeles, Calif. 90015

[21] Appl. No.: 611,359

[22] Filed: Sep. 8, 1975

[51] Int. Cl.[2] ..... B42F 13/00; A44B 21/00

[52] U.S. Cl. ..... 40/617; 248/317

[58] Field of Search ..... 24/85 A, 3 M, 67.5, 24/67.7, 73 CS, 73 AS, 154; 248/497, 498, 311; 40/128, 125; 211/45

[56] References Cited

U.S. PATENT DOCUMENTS

| | | | |
|---|---|---|---|
| 609,823 | 8/1898 | Love | 40/128 |
| 1,012,594 | 12/1911 | Cain | 24/73 CS |
| 1,365,320 | 1/1921 | Hohnsbeen | 24/67.5 |
| 1,460,502 | 7/1923 | Rudesill | 24/67.7 |
| 1,712,966 | 5/1929 | Marsa | 40/128 |
| 1,907,495 | 5/1933 | Brunski | 248/497 |
| 2,112,940 | 4/1938 | Voss | 24/73 CS |
| 2,487,339 | 11/1949 | Kindlund | 24/3 M |
| 3,220,129 | 11/1965 | Goodman | 40/128 |
| 3,300,173 | 1/1967 | Kennedy | 248/498 |
| 3,949,915 | 4/1976 | Burhans | 23/3 M |
| 3,977,047 | 8/1976 | Lege | 24/73 AS |

FOREIGN PATENT DOCUMENTS

| | | | |
|---|---|---|---|
| A692,018 | 6/1932 | France | 24/154 |
| 15,875 of | 1892 | United Kingdom | 24/73 CS |
| 17,059 of | 1905 | United Kingdom | 40/128 |

*Primary Examiner*—Bernard A. Gelak

[57] ABSTRACT

Slender clips grip a vertical rod and hold post cards by their left-hand borders so that they may be rotated and examined on both sides without being removed. Two or more mounts hold the rod close off a vertical surface such as a cork board, wall, or mirror, and are provided with flanges for slipping between a bulletin board frame and its major surface. The mounts also have holes for thumbtacks. One of these mounts may be used alternatively to fasten to a bulletin board a short chain from which a small bulldog clip or small levered clothespin holding a post card by its top edge is suspended. Such a mount may itself be replaced by a very stout large-headed pin.

2 Claims, 3 Drawing Figures

POST CARD DISPLAYER FASTENING ON BULLETIN BOARD

Over the years, numberless people have noted imperfections in the way picture post cards received in the mail are displayed on bulletin boards by fixation with thumbtacks, so that the messages are faced to the board and cannot be read except by removal of the cards. Turning the card is unhandy and time-consuming, and it results in marring the card with multiple holes, in dropping and loss of tacks with danger to the soles of feet, and in shortage of tacks, made up for by transfer of tacks, with breakdown in display of other messages.

The object of my invention is to avoid these problems. It is evident that if cards could be inserted in slender clips on hinges, they could be displayed to show the picture side, and flipped over for the reading of the signature and messages. In places of employment, people look to the bulletin board for word from their fellow-workers who are away on vacation. My invention is mounted on a bulletin board with its rod vertical, acting as the pin of a hinge. Besides holding post cards, the device holds pamphlets so both sides may be read, and single or multiple sheets of paper. It can be placed horizontally, and it can be mounted on some mirrors having frames. Forming different species and recombinating parts can expand usefulness of my invention so as to adapt it to various cards, and fasten it to walls, glass surfaces, frames, and bulletin boards.

The accompanying drawing helps clarify the description of my invention.

Figure 1:
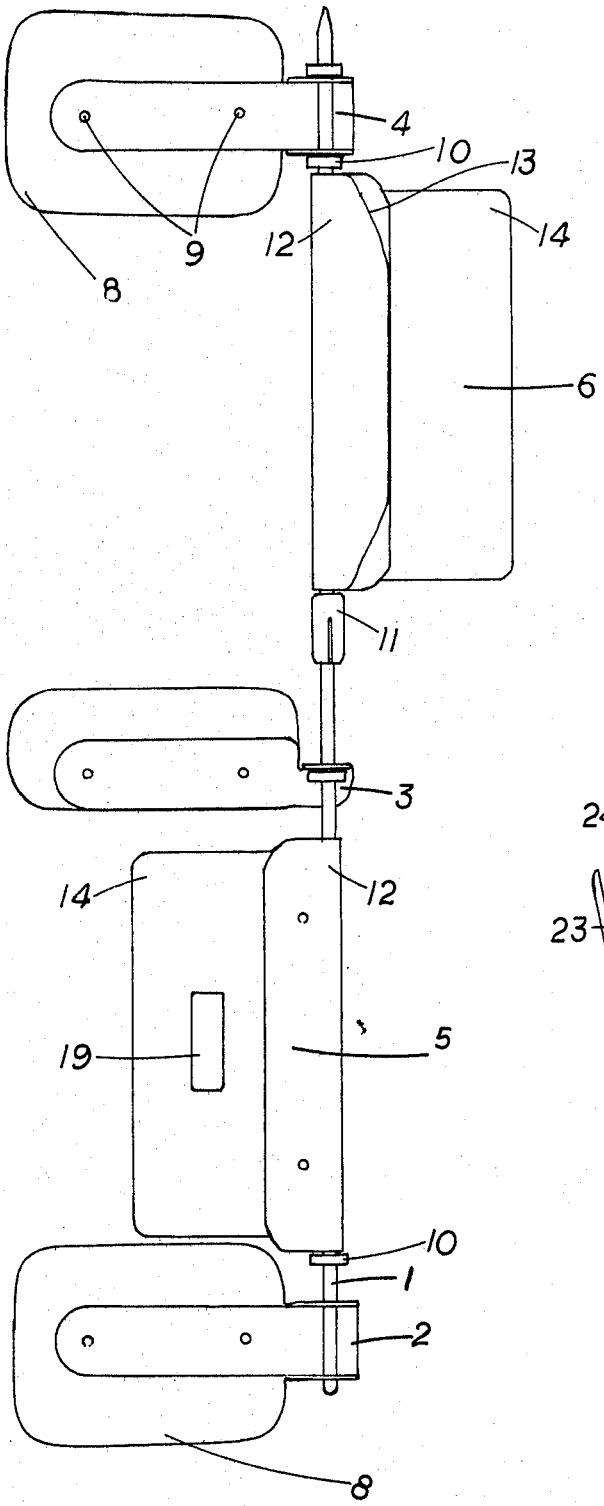
FIG. 1 is a front view of one embodiment, of a size to hold two post cards, the upper card clip positioned to display the front or picture side, the lower card clip rotated to display the writing on the back.

The species shown in FIGS. 1 & 2 can display a number of cards at once, and is most useful for delivered post cards, in which case the rod, hereinafter called the vertical rod 1 would be mounted vertically, but it may be mounted horizontally, and variously on surfaces. Although useful in several ways, this embodiment, for simplicity's sake, is described herewith in its commonest application. The card display device comprises a vertical rod rigidly attached to a mount means 2 for fastening the rod to a bulletin board close to its surface; additional mount supports 3 & 4 for the rod, fastening to the bulletin board; and one or several clips 5 & 6 rotatable on the rod and designed to each hold a picture post card 7 of FIGS. 2 & 3, received in the mail.

The major rod supports or mounts 2 & 4, the end ones, have thin flared edges 8 for insertion beneath the frame of the bulletin board at the inside corners, or otherwise under the left or right inside edges of the frame. Any of the corners may be employed. Thumbtack holes 9 are provided in the supports, and all of these can be used for fixation out on the board away from the frame, or even for fixation on the uprights of the frame itself. Gripping rubber-like collars 10, or hard collars 11, split and bent inward constrictively at one end, are mounted on the rod at selected points, for obtaining proper spacing of a series of cards. Rubbery collars help maintain the cards facing out or facing in. A rod long enough to support many cards may have its middle steadied by an auxiliary support 3, and several supports may be used if the rod is exceptionally long.

Figure 2:
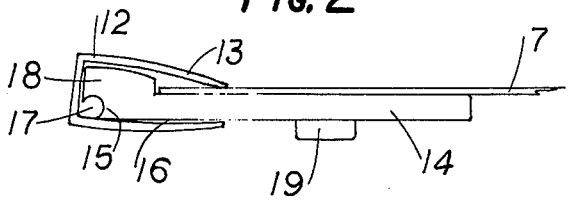
FIG. 2 is an enlarged cross-sectional view of one of the card clips shown in FIG. 1.

Each card clip 5, 6, & FIG. 2, may be made of a slender resilient plastic or metal channel 12, cut away at the front corners 13, making it easy to slip the edge of the card in by sliding it vertically. The card is held firmly against a backing, called the platform 14, preferably of transparent plastic to permit reading through. The platform enters into the bearing for the clip on the rod, and may be grooved 15 on one edge for a gripping fit. The platform is fastened to the back flange of the channel only, on the inside, 16, by cementing, riveting, or otherwise, or can be an integral part of the channel, and if the hole 17 for the rod is small, the rod will be gripped by the channel member so that the clip and its card will not flap loosely. A long ridge 18 is provided on the front side of the platform, to act as a backstop for the engaged edge of the post card, so it can be aligned horizontally wieh ease. The ridge prevents insertion too far, and thus the card does not press against the bearings or the collars. A block 19 on the back of the platform prevents its rotation too close against the board and so prevents curling of the cards.

The card clip can be made wholly or partly out of thin sheet steel or similar material, in one piece, with slender springs arching over the picture surface for pressing the card against the platform, a bent edge of the platform providing the backstop, extensions of the ends of the platform perforated and bent backward, to form the bearings for the vertical rod, and springs arching back to press on the rod and brake the clip's rotation. The slender slips pressing the card against the platform may be curled at their tips so as to allow the cards to be slipped horizontally into place. Rod supports 2, 3, & 4 may be fastened by adhesive tape or cement to a smooth surface such as a wall, glass partition, or mirror.

Figure 3:
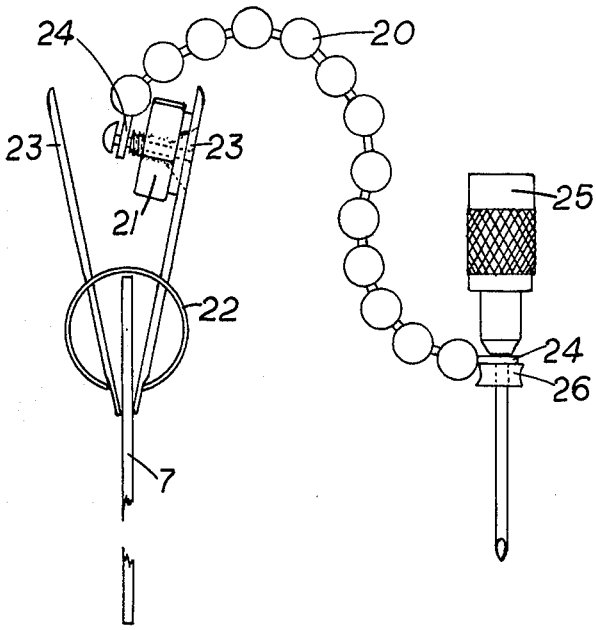
FIG. 3 shows, enlarged, an end view of the card clip of another embodiment of the invention, and a side view of its large-headed suspension pin and its connecting chain.

The described supports 2, 3, & 4 forming bearings for the vertical rod can be mounted along the top of the bulletin board for holding post cards in another way. A short chain 20, FIG. 3, is added on, attaching distally to a special mounting 21 on a Number 0 bulldog clip or similar device such as a small levered clothespin, the chain ending midway between the holes of the clip's two arms 23 for the finger and thumb. A chain having eyelet endings 24 is satisfactory. Instead of this means of fastening to the bulletin board, fastening may be by a device 25 resembling a small intravenous needle, the position of the eyelet on the shaft being regulated if desired by a small gripping rubber-like washer 26 to each side of the eyelet. The device 25 is a large-headed pin with shaft long enough and sturdy enough to be plunged deeply into the bulletin board. In the illustration, it is shown short enough to require only one gripping washer 26. Cards depicting tall slender objects are conveniently displayed having the narrow top border up, employing the chain-bearing embodiment, as they are easily rotated 90° when turned over for reading of the message. In this case, it is especially easy, if desired, to withdraw the card for reading from the clamp, reclamping it afterwards. The chain may be replaced by a rod having hinge motion outward at its proximal end and axial rotatory motion at one end.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

I claim:

1. In a card and bulletin displaying device comprising a small spring-loaded, finger and thumb operated clip having opposing levers for nondestructively, non-intrusively, and releasably holding a card by the middle of its upper margin, a suspending length of chain fastened closely above by a fixation means to a supporting structure having a broad perpendicular surface and fastened below by a coupling means to one of the finger levers of said clip, said coupling means spacing the terminus of said chain off said finger lever to a position midway between said finger levers, so that said card, suspended, is held closely against said perpendicular surface with either front or back displayed, and so it can be easily variously held in the hand and turned over for viewing and reading.

2. The combination of claim 1 wherein said fixation means is a stout pin for thrusting into said supporting structure, the shaft of which said pin has been inserted through a hole in the upper terminal link of said chain; and wherein two small rubbery gripping washers are also threaded onto said shaft, one washer distally to said link for retaining said chain on said shaft before said thrusting, the other washer proximal to said link, to be pushed distally along said shaft after said thrusting so as to hold said chain close to said supporting structure and thereby hold said clip and its card against it, preventing dangling and fluttering.

* * * * *